US008434470B2

(12) United States Patent
Jensen

(10) Patent No.: US 8,434,470 B2
(45) Date of Patent: May 7, 2013

(54) ADJUSTABLE BURN APPARATUS

(75) Inventor: Seth Jensen, Racine, WI (US)

(73) Assignee: Jensen Metal Products, Inc., Racine, WI (US)

( * ) Notice: Subject to any disclaimer, the term of this patent is extended or adjusted under 35 U.S.C. 154(b) by 317 days.

(21) Appl. No.: 12/856,750

(22) Filed: Aug. 16, 2010

(65) Prior Publication Data

US 2012/0037141 A1 Feb. 16, 2012

(51) Int. Cl.
*F24C 5/00* (2006.01)
*F24B 1/18* (2006.01)
*F23Q 2/32* (2006.01)

(52) U.S. Cl.
USPC ..... 126/93; 126/512; 431/125

(58) Field of Classification Search ..... 126/93, 126/512; 431/125
See application file for complete search history.

(56) References Cited

U.S. PATENT DOCUMENTS

| | | | | |
|---|---|---|---|---|
| 2,531,828 | A | 11/1950 | Schultz | |
| 3,413,967 | A | 12/1968 | Hoock | |
| 3,606,609 | A | 9/1971 | Lipper et al. | |
| 4,150,610 | A | 4/1979 | Ferrara | |
| 4,482,478 | A * | 11/1984 | Shaw | 252/579 |
| 4,573,905 | A | 3/1986 | Meyers | |
| 4,582,478 | A * | 4/1986 | Hilker | 431/125 |
| 4,818,842 | A | 4/1989 | Walty | |
| 4,890,600 | A | 1/1990 | Meyers | |
| 5,026,271 | A * | 6/1991 | Orlov et al. | 431/125 |
| 5,399,084 | A | 3/1995 | McCullough et al. | |
| 5,743,249 | A | 4/1998 | Boekeloo et al. | |
| 5,794,610 | A | 8/1998 | Facchina | |
| 6,267,113 | B1 | 7/2001 | Maust et al. | |
| 6,609,514 | B1 | 8/2003 | Bertolas | |
| 7,182,594 | B1 | 2/2007 | Malafouris | |
| 7,287,979 | B2 | 10/2007 | Backes et al. | |
| D569,493 | S | 5/2008 | Weinberger | |
| D583,919 | S | 12/2008 | Backes et al. | |
| 7,458,808 | B2 | 12/2008 | McCarren | |
| 2005/0150487 | A1 | 7/2005 | Weinberger | |
| 2005/0178379 | A1 | 8/2005 | Weinberger | |
| 2005/0227194 | A1 | 10/2005 | Weinberger | |
| 2005/0247302 | A1 | 11/2005 | Weinberger | |
| 2006/0110695 | A1 | 5/2006 | Weinberger | |
| 2006/0157049 | A1 | 7/2006 | Weinberger | |
| 2011/0186039 | A1 * | 8/2011 | Chomiuk et al. | 126/512 |

OTHER PUBLICATIONS

Restoration Hardware Installation Manual for River Rock Fire Bowl Style # 26100037 dated Nov. 22, 2006, pp. 2-12.*

* cited by examiner

*Primary Examiner* — Kenneth Rinehart
*Assistant Examiner* — William Corboy
(74) *Attorney, Agent, or Firm* — Jansson Munger McKinley & Shape Ltd.

(57) ABSTRACT

An adjustable burn apparatus for a fireplace using a liquid or gel-type fuel. The apparatus includes an elongate housing with an elongate top opening into which an elongate removable fuel container is inserted. The removable fuel container has an elongate open top of a length approximating the length of the elongate housing, and an elongate cover which is hinged to the housing preferably along its long dimension and has an elongate flame opening. The hinged cover itself has a shutter slidably secured at its lower surface that is movable along positions opening, controlling and closing the flame opening.

18 Claims, 9 Drawing Sheets

ADJUSTABLE BURN APPARATUS

FIELD OF THE INVENTION

This invention is related generally to fireplace apparatus which utilize gel or liquid fuel and, more specifically, to flame-control apparatus therefor.

BACKGROUND OF THE INVENTION

So-called "ventless fireplaces," i.e., fireplaces which burn gel or liquid fuel, exist in a variety of forms. Such fireplaces typically have several advantages over various more-traditional fireplaces in that ventless fireplaces cleanly burn their fuel, are often portable, and may not require installation. Typically, it is advantageous for a ventless fireplace to include some sort of shutter mechanism to control the flame. It is to shutter mechanisms and related control apparatus that this invention is primarily directed.

In the ventless fireplace field, there is a need for an improved large-capacity, refillable and adjustable burn apparatus for use in a variety of ventless fireplace applications. One such application is ventless fireplaces for walls, as may be used in homes, apartments, porches or the like.

SUMMARY OF THE INVENTION

This invention is an adjustable burn apparatus for a fireplace for a liquid or gel type fuel. The adjustable burn apparatus of this invention includes an elongate housing with an elongate top opening, the housing being adapted for insertion of a removable fuel container therein which itself is elongate and has an elongate open top of a length nearly approximating the length of the (preferably rectangular) housing.

The burn apparatus of this invention includes an elongate cover that is hinged to the housing along an upper edge thereof and over the elongate open top of the removable fuel container. The cover has a lower surface and defines an elongate flame opening and has a shutter slidably secured at the lower surface thereof which is movable along positions opening, controlling and closing the flame opening. The elongate cover is hinged to the housing along the length thereof.

In preferred embodiments, the cover-mounted shutter includes an upward shutter control nub projecting above the cover to facilitate shutter movement. The nub is adapted for engagement by a hooked tool for hands-free control of the shutter.

Preferably, the cover includes an edge-adjacent aperture for use with the same hooked tool for hands-free opening and closing of the cover. It is also preferred that the removable fuel container include an in-container upwardly-projecting element with a hole therethrough for engagement by the same hooked tool for hands-free removal and insertion of the fuel container with respect to the housing.

In preferred embodiments, the cover includes a fixed shutter-stop member on the lower surface of the cover. The shutter stop is preferably elongate, and such shutter stop preferably also functions as a stiffener for the cover. It is also preferred that the lower surface of the cover include two welded bars each having a first end affixed to the shutter-stop member and a second end being affixed to a downwardly-projection lip of the cover. The shutter slides along the two welded bars in its movement between open and closed positions, and to positions of flame adjustment therebetween.

Preferably the adjustable burn apparatus uses a fuel such as isopropanol or ethanol, each either in a liquid or gel fuel form. It is highly preferred that the housing be a secondary containment vessel free of apertures to facilitate containment of spilled fuel, and advantage given typical uses of ventless fireplace apparatus.

The capacity of fuel container is large because the dimensions of the fuel container are such that its size approximates the size of the housing itself, subject only to reasonable requirements for convenient removable mounting of the fuel container within the housing. However, the area of the elongate flame opening in the cover is small in size relative to the area of the open top of the fuel container. The elongate flame opening, while fairly long to provide a visually-broad flame area, is also fairly narrow. This relative sizing provides a long burn time, i.e., a long time before the need arises to replenish the fuel in the fuel container. The incorporation of on, off and control shuttering right in a hinged lid itself facilitates these advantages and provides an easily-operated, adjustable ventless burn apparatus which is readily refillable.

The hooked tool which, as mentioned above, has at least three control functions, also has an edge that provides a scraping portion to facilitate scraping the surfaces of the lateral walls of the fuel container for convenient cleaning purposes.

It is preferable that the fireplace apparatus of this invention be adapted to be a removable unit for use in a wall-type ventless fireplace.

BRIEF DESCRIPTION OF THE DRAWINGS

The drawings illustrate a preferred embodiment including the above-noted characteristics and features of the invention. The invention will be readily understood from the descriptions and drawings. In the drawings.

DETAILED DESCRIPTION OF PREFERRED EMBODIMENTS

Figure 1:
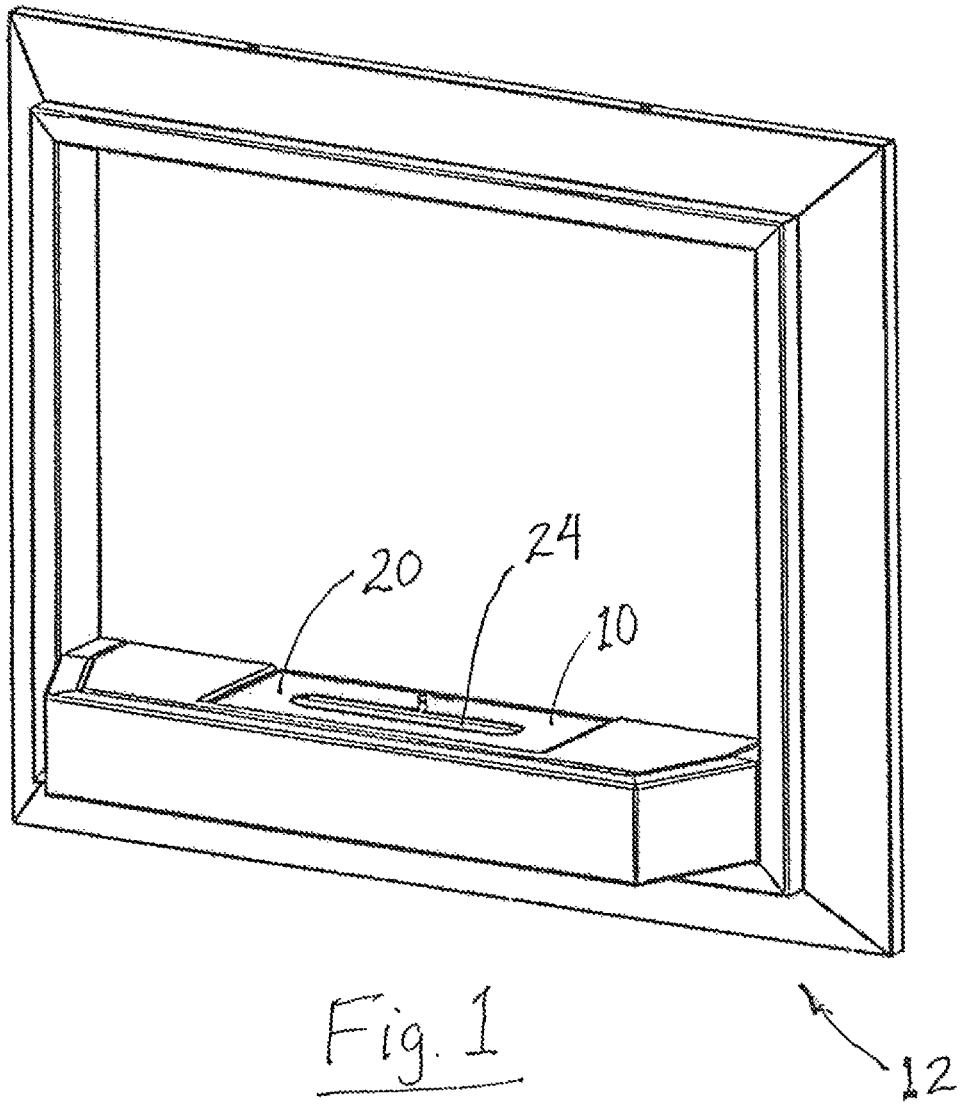
FIG. 1 is a perspective view of a wall fireplace unit having an adjustable burn apparatus in accordance with this invention.
Figure 2:
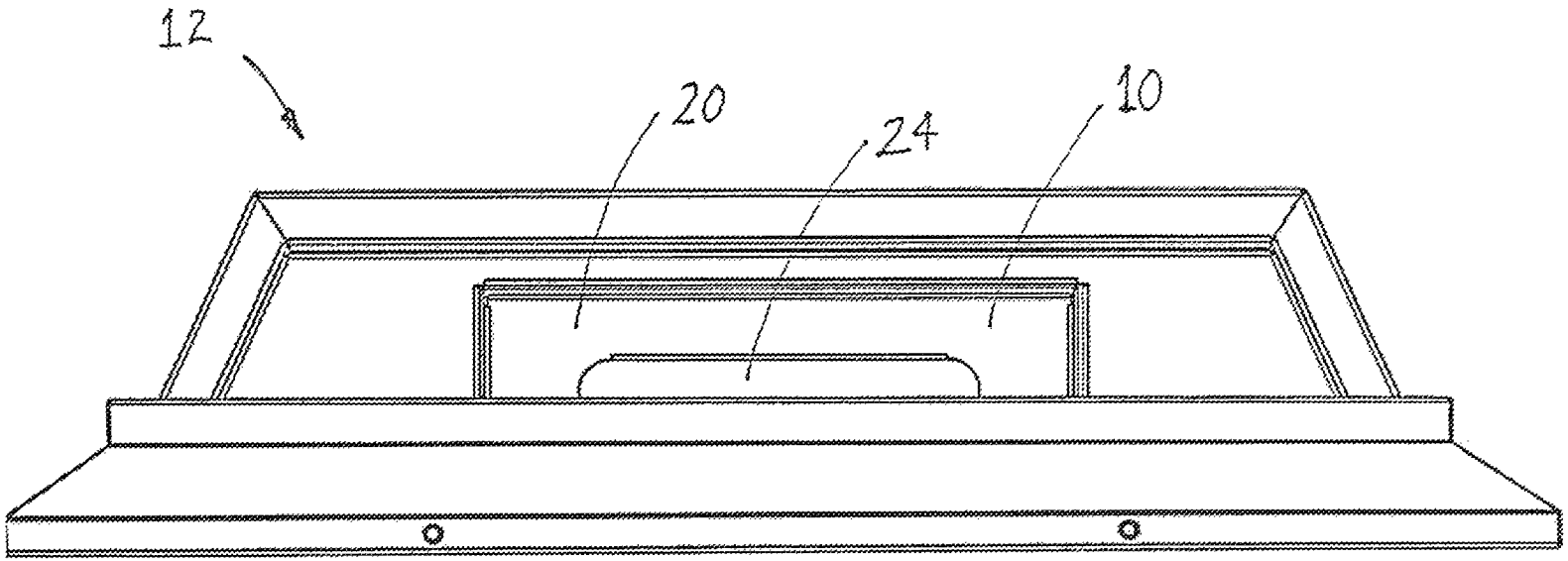
FIG. 2 is a top plan view of such wall fireplace unit of FIG. 1.
Figure 3:
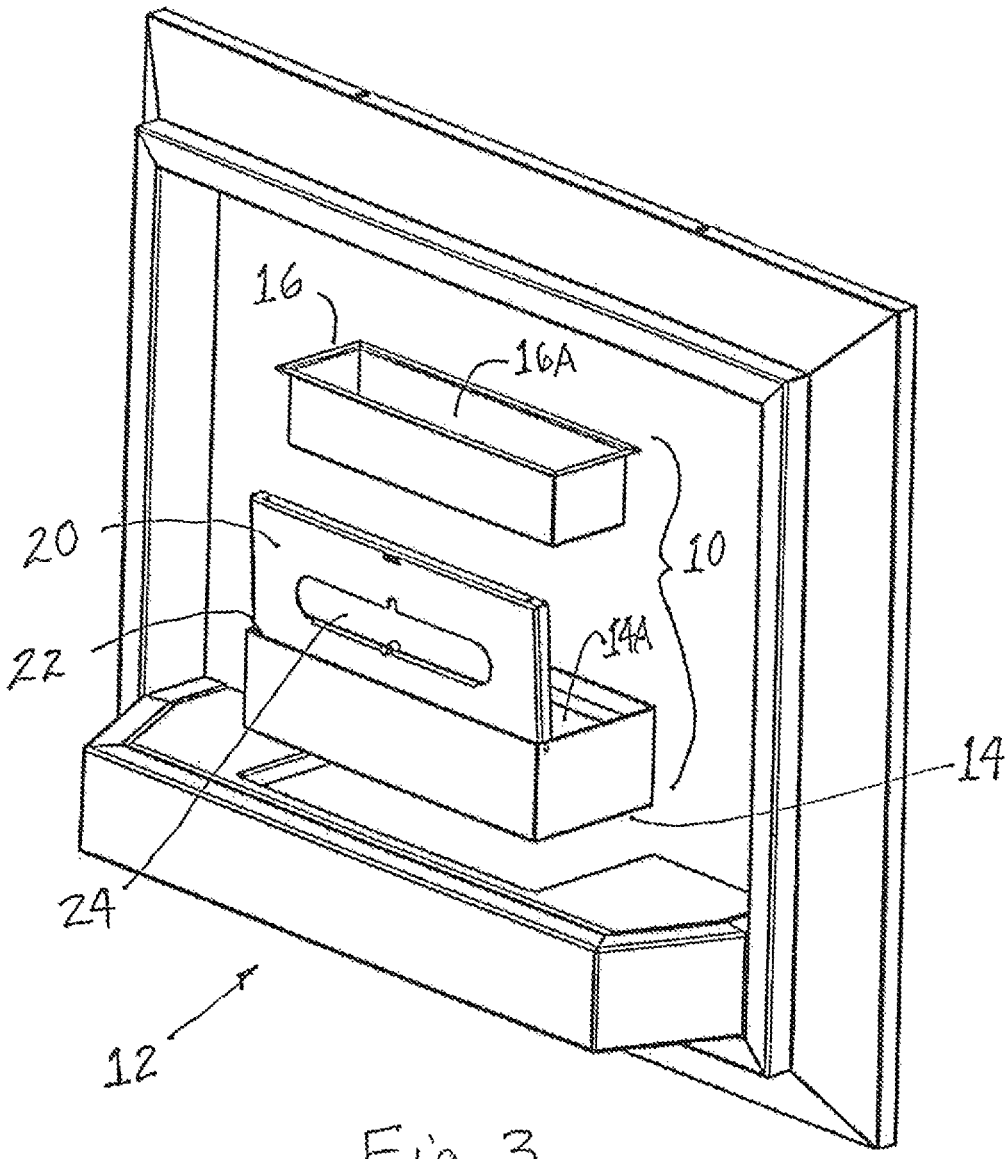
FIG. 3 is an exploded perspective view of the wall fireplace unit of FIG. 1.

As shown in the figures, this invention is an adjustable burn apparatus 10 of a type for use in ventless fireplaces for liquid or gel-type fuels. FIGS. 1-3 illustrate one such ventless fireplace, namely, a wall fireplace 12 in which adjustable burn apparatus 10 is removable inserted in a space made to accommodate such apparatus.

Adjustable burn apparatus 10, as illustrated in the drawings, includes an elongate housing 14 with an elongate top opening 14A. Housing 14 is adapted for insertion therein of a removable fuel container 16 which itself is elongate. Elongate fuel container 16 has an elongate open top 16A of a length nearly approximating the length of housing 14, as illustrated best in FIGS. 3 and 8. Adjustable burn apparatus 10 also includes an elongate cover 20 which is hinged to housing 14 at hinge 21 along elongate front upper edge 22 of housing 14. Cover 20 extends over elongate open top 18A of removable fuel container 16, and defines an elongate flame opening 24 which is relatively small in area compared to the area of elongate open top 16A of fuel container 16.

Figure 4:
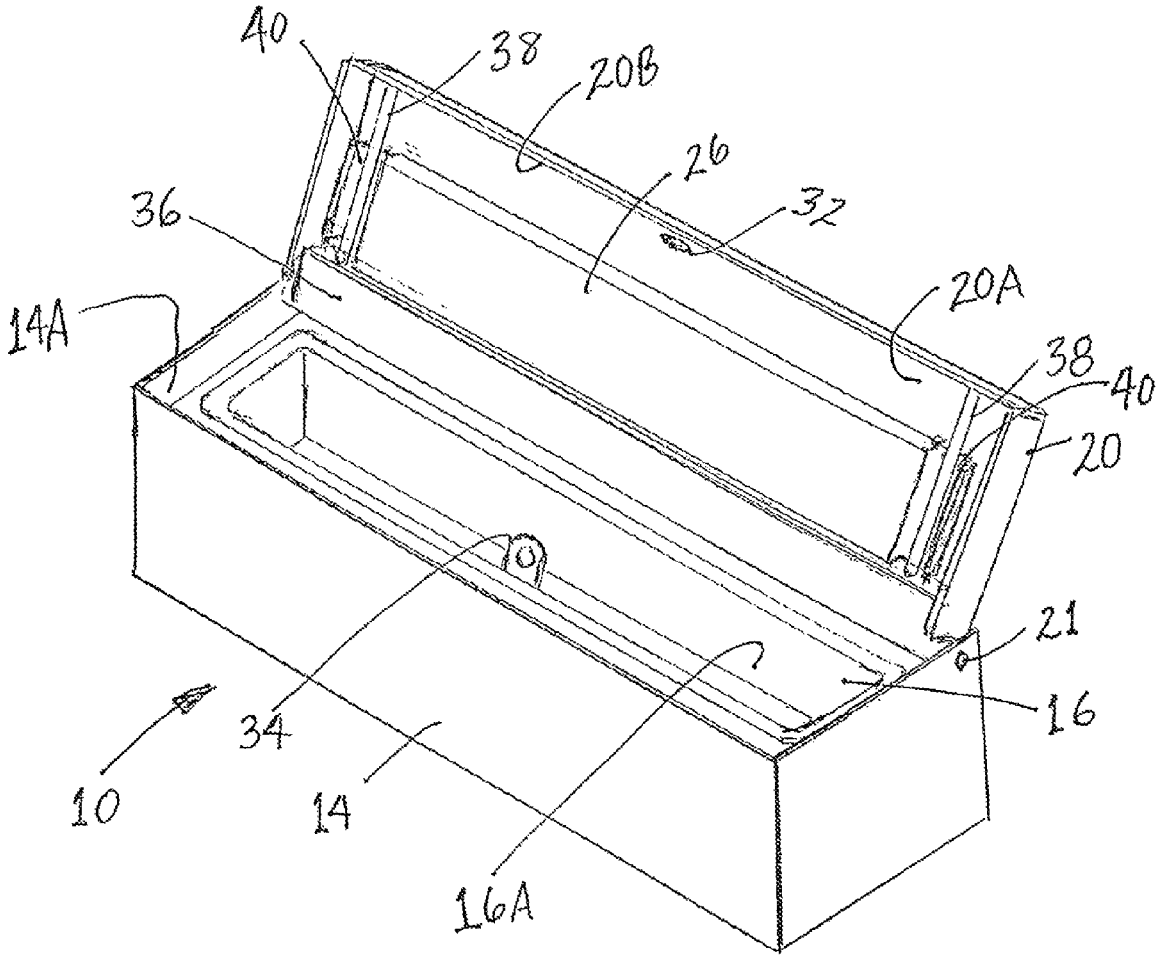
FIG. 4 is a perspective view of the adjustable burn apparatus with the cover open, showing the underside of the cover.

As shown best in FIG. 4, cover 20 has a lower surface 20A to which a shutter 26 is slidably secured such that shutter 26 is movable along positions which open, control and closes flame opening 24. Cover-mounted shutter 26 includes an upward shutter control nub 28 that projects above cover 20 to facilitate movement of shutter 26 with respect to flame opening 24.

Nub 28 is shaped for engagement by a hooked tool 30 for hands-free control of the shutter. Cover 20 includes an edge-adjacent aperture 32 which is configured for engagement by the same hooked tool 30 to facilitate hands-free opening and closing of cover 20. Fuel container 16 includes an upwardly-projecting in-container removal element 34 with a hole therethrough for engagement by hooked tool 30 for hands-free removal and insertion of fuel container 16 with respect to housing 14. Hooked tool 30 also has an edge portion 31 which is useful to facilitate scraping the inner surfaces of fuel container 16.

As seen in FIG. 4, hinged elongate cover 20 includes a fixed shutter-stop member 36 on lower surface 20A thereof. Shutter-stop member 36 is elongate, and is positioned for engagement by shutter 26 at an end of its shutter stroke. Shutter-stop member 36 also functions as a stiffener for the cover, to avoid heat warping thereof. Lower surface 20A of cover 20 also includes two welded bars 38 each having a first end affixed to shutter-stop member 36 and a second end affixed to a downwardly-projection lip 20B of cover 20. Shutter 26 includes bar-riding members 40 at the opposing ends thereof configured such that shutter 26 slides along welded bars 38 in its movement between the open and closed shutter positions, and to positions for controlling flame adjustment therebetween.

Housing 14 is free of apertures therein, including along the joints between its side and bottom wall portions. Thus, housing 14 can function as a secondary containment vessel which prevents spills even if errors are made in pouring fuel into fuel container 16.

Figure 5:
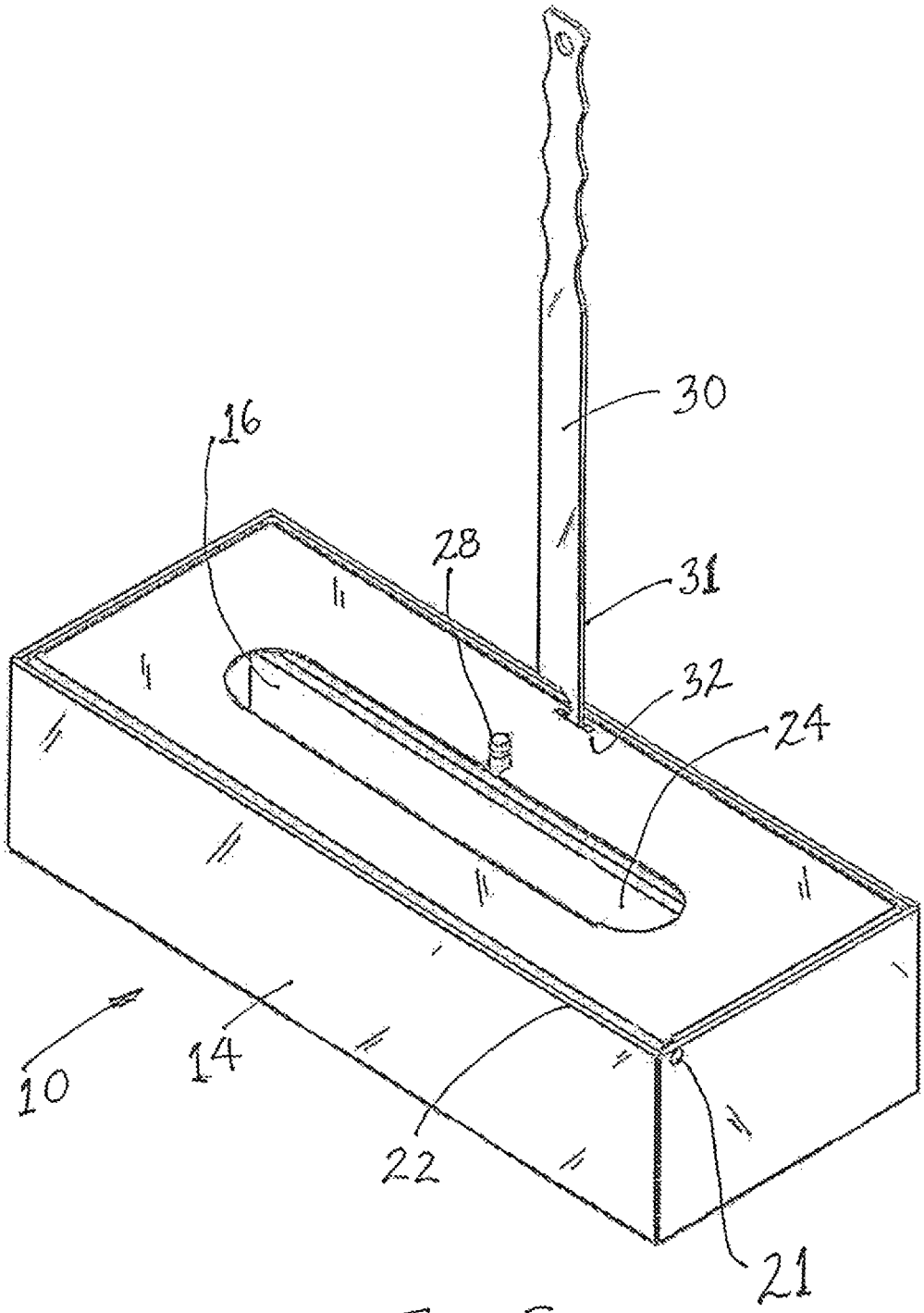
FIGS. 5-7 are a series of perspective views from the rear of FIG. 4, showing, among other things, use of a hooked took for opening the cover.
Figure 6:
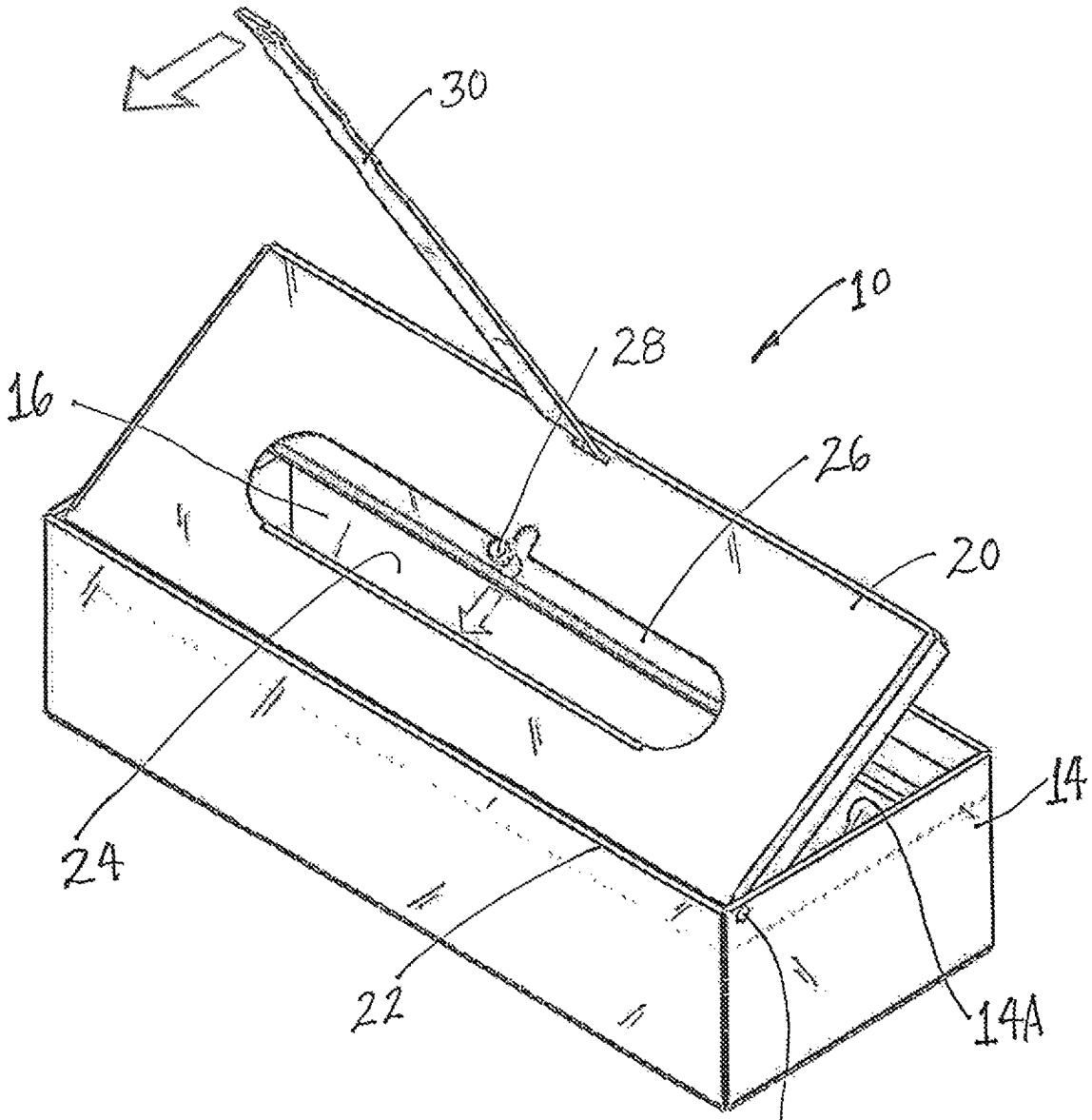
Figure 7:
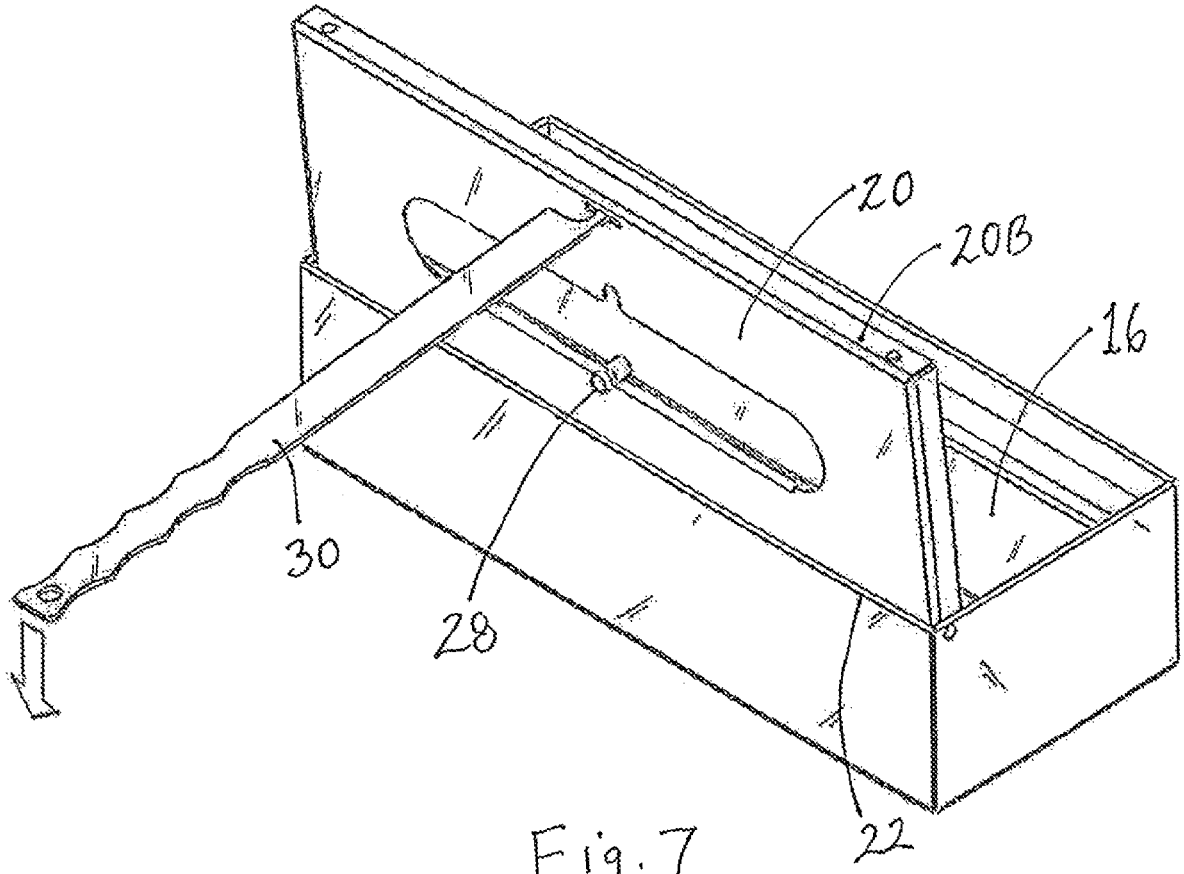
Figure 8:
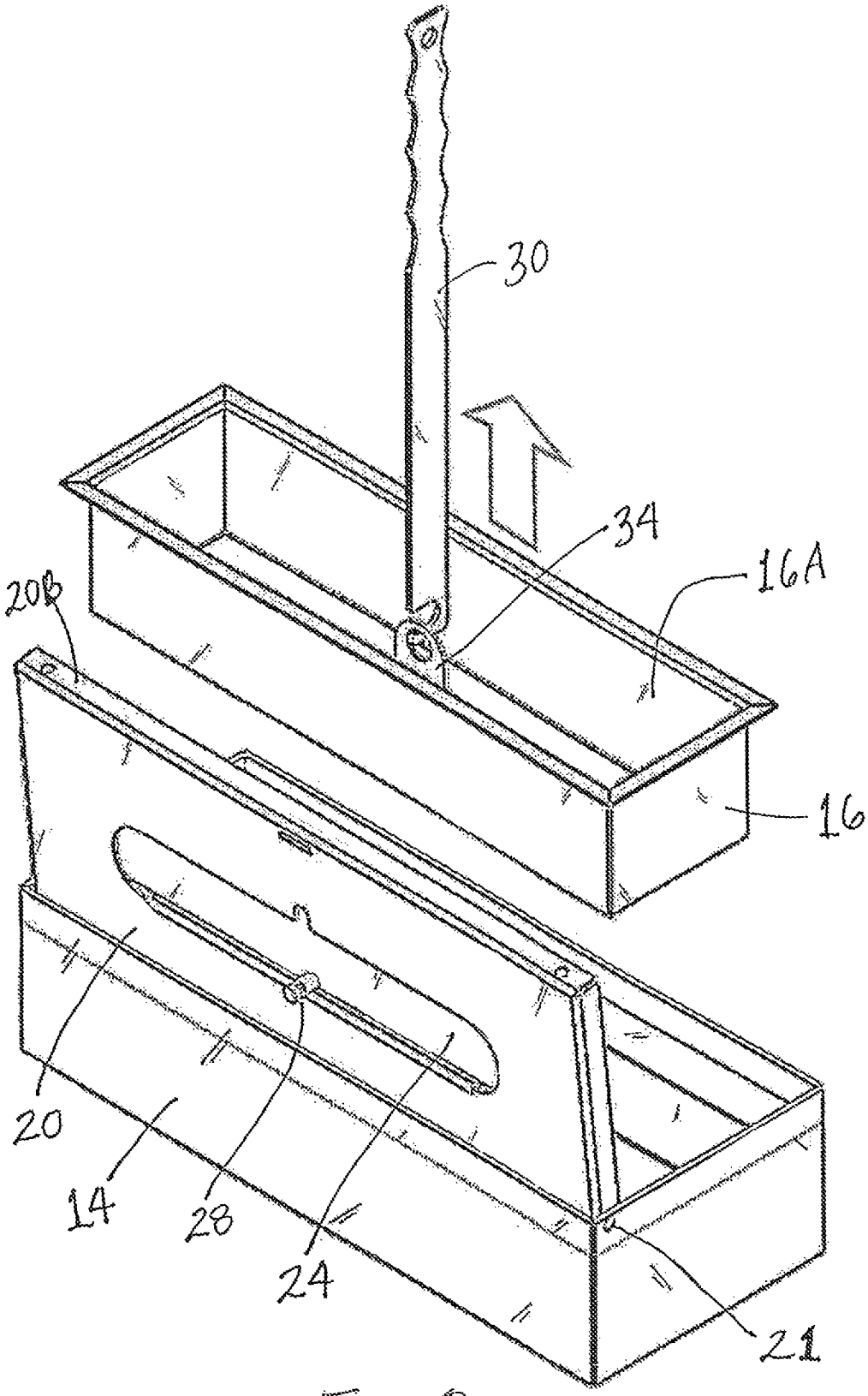
FIG. 8 is an exploded perspective view showing, among other things, use of the same tool for removal of the fuel container.
Figure 9A:
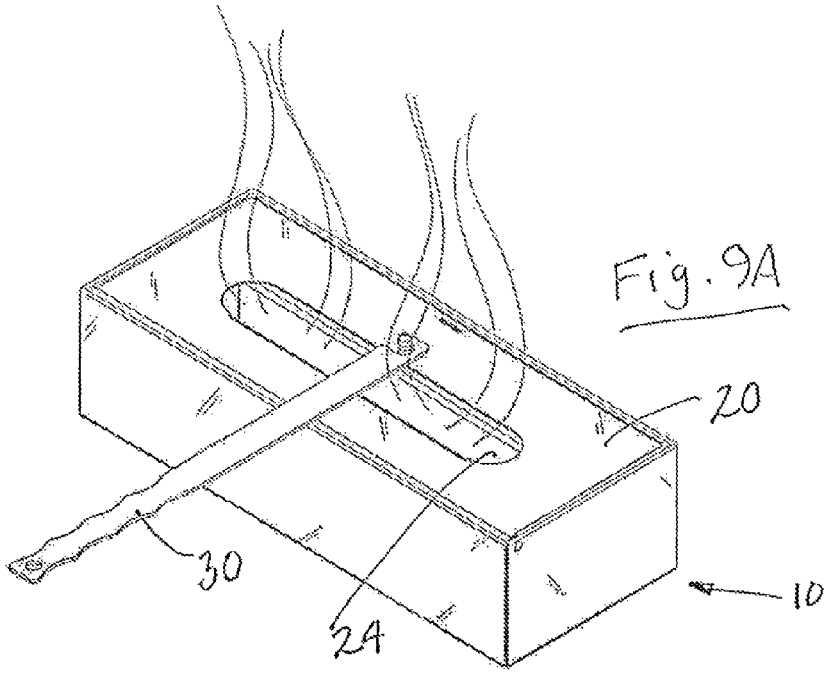
FIGS. 9A-9C are perspective views showing, among other things, operation of the shutter of the hinged cover, using the same tool.
Figure 9B:
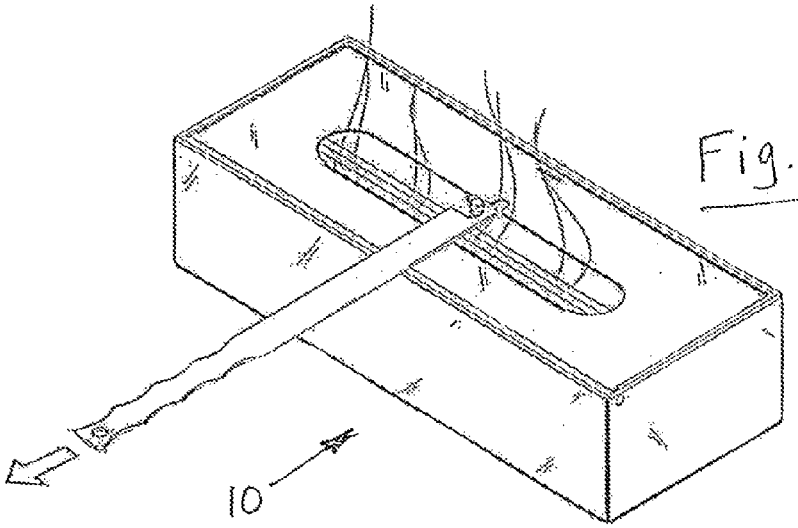
Figure 9C:
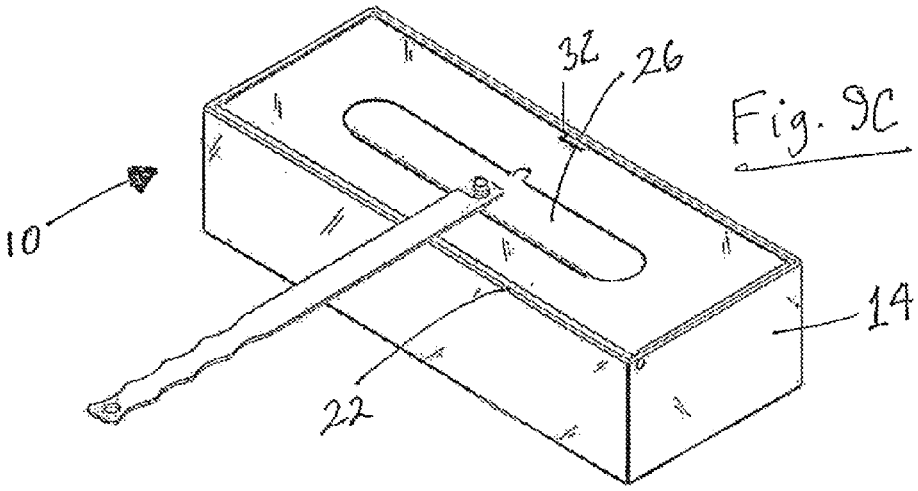

FIGS. 5-8 and 9A-9C illustrate how, in preferred embodiments of this invention, tool 30 facilitates hand-free operation and adjustment, thereby avoiding concerns about hand contact with hot objects. FIGS. 5-7 illustrate the opening of elongate cover 20 using such tool. FIG. 8 illustrates removal of fuel container 16 for refilling, using such tool. And, FIGS. 9A-9C illustrate operation of shutter 26 (which is below cover 20) from a position above cover 20, using such tool.

The apparatus of this invention is preferably fabricated of metal, such as stainless steel or the like. Fabrication is primarily by welding, as is well-known in the art of ventless fireplaces. A wide variety of dimensioning is also possible, although it is highly preferred that the relatively large capacity of the fuel container and the relatively small size of the shuttered opening be such as to provide a long burning time, i.e., a long time before the need arises to replenish the fuel in the fuel container.

While the principles of this invention have been described in connection with specific embodiments, it should be understood clearly that these descriptions are made only by way of example and are not intended to limit the scope of the invention.

The invention claimed is:

1. An adjustable burn apparatus for a fireplace for a liquid or gel-type fuel including:

an elongate housing with an elongate top opening, the housing being adapted for insertion of a removable fuel container therein;

the removable fuel container itself being elongate and having an elongate open top of a length approximating the length of the elongate housing;

an elongate cover hinged to the housing along an upper edge thereof and over the elongate open top of the removable fuel container, the cover having a lower surface and defining an elongate flame opening and including a fixed, elongate shutter-stop member on the lower surface of the cover and two bars each having a first end being affixed to the shutter-stop member and a second end affixed to a lip portion of the cover, the shutter-stop functioning as a stiffener for the cover; and a shutter slidably secured at the lower surface of the cover and being in sliding engagement with the bars and movable along positions opening, controlling and closing the flame opening.

2. The adjustable burn apparatus of claim 1 wherein the shutter includes an upward shutter control nub projecting above the cover to facilitate shutter movement, the nub adapted for engagement by a hooked tool for control of the shutter.

3. The adjustable burn apparatus of claim 2 wherein:

the cover includes an edge-adjacent aperture for use with the hooked tool for opening and closing of the cover; and the removable fuel container includes an in-container upwardly projecting element with a hole therethrough for engagement by the hooked tool for removal and insertion of the fuel container with respect to the housing.

4. The adjustable burn apparatus of claim 1 wherein the adjustable burn apparatus has a fuel selected from the group consisting of isopropanol and ethanol, each either in a liquid or gel fuel form.

5. The adjustable burn apparatus of claim 1 wherein the elongate cover is hinged to the housing along the length thereof.

6. The adjustable burn apparatus of claim 1 wherein the elongate flame opening is small in size relative to the fuel container.

7. The adjustable burn apparatus of claim 1 wherein the fireplace is a wall unit and the adjustable burn apparatus is removable thereto.

8. The adjustable burn apparatus of claim 1 wherein the housing is a secondary containment vessel free of apertures to facilitate containment of spilled fuel.

9. The adjustable burn apparatus of claim 2 wherein the hooked tool has an edge which is a scraping portion to facilitate scraping inner lateral surfaces of the fuel container.

10. An adjustable burn apparatus for a fireplace for a liquid or gel-type fuel including:

a housing with an opening, the housing being adapted for insertion of a removable fuel container therein;

the removable fuel container itself having an opening of a length nearly approximating the length of the housing;

a cover hinged to the housing along an upper edge thereof and over the opening of the removable fuel container, the cover having a lower surface and defining a flame opening and including a fixed, elongate shutter-stop member on the lower surface of the cover and two bars each having a first end being affixed to the shutter-stop member and a second end affixed to a lip portion of the cover, the shutter-stop functioning as a stiffener for the cover; and a shutter slidably secured at the lower surface of the cover and being in sliding engagement with the bars and movable along positions opening, controlling and closing the flame opening.

11. The adjustable burn apparatus of claim 10 wherein the shutter includes an upward shutter control nub projecting above the cover to facilitate shutter movement, the nub adapted for engagement by a hooked tool for control of the shutter.

12. The adjustable burn apparatus of claim 11 wherein:

the cover includes an edge-adjacent aperture for use with the hooked tool for opening and closing of the cover; and the removable fuel container includes an in-container upwardly projecting element with a hole therethrough for engagement by the hooked tool for removal and insertion of the fuel container with respect to the housing.

13. The adjustable burn apparatus of claim 10 wherein the adjustable burn apparatus has a fuel selected from the group consisting of isopropanol and ethanol, each either in a liquid or gel fuel form.

14. The adjustable burn apparatus of claim 10 wherein the cover is elongate and hinged to the housing along the length thereof.

15. The adjustable burn apparatus of claim 10 wherein the flame opening is elongate and small in size relative to the fuel container.

16. The adjustable burn apparatus of claim 10 wherein the fireplace is a wall unit and the adjustable burn apparatus is removable thereto.

17. The adjustable burn apparatus of claim 11 wherein the hooked tool has an edge which is a scraping portion to facilitate scraping inner lateral surfaces of the fuel container.

18. The adjustable burn apparatus of claim 11 wherein the housing is a secondary containment vessel free of apertures to facilitate containment of spilled fuel.

* * * * *

UNITED STATES PATENT AND TRADEMARK OFFICE

CERTIFICATE OF CORRECTION

PATENT NO. : 8,434,470 B2
APPLICATION NO. : 12/856750
DATED : May 7, 2013
INVENTOR(S) : Jensen It is certified that error appears in the above-identified patent and that said Letters Patent is hereby corrected as shown below:

In the Claims

In column 6, claim 18, line 17, delete "11" and replace with --10--.

Signed and Sealed this
Fifteenth Day of April, 2014

Michelle K. Lee

Michelle K. Lee
*Deputy Director of the United States Patent and Trademark Office*